US006827680B2

(12) United States Patent
Niemerg

(10) Patent No.: US 6,827,680 B2
(45) Date of Patent: Dec. 7, 2004

(54) CENTRIFUGE

(75) Inventor: Willi Niemerg, Oelde (DE)

(73) Assignee: Westfalia Separator AG, Oelde (DE)

( * ) Notice: Subject to any disclaimer, the term of this patent is extended or adjusted under 35 U.S.C. 154(b) by 0 days.

(21) Appl. No.: 10/433,831

(22) PCT Filed: Jan. 11, 2002

(86) PCT No.: PCT/EP02/00221

§ 371 (c)(1),
(2), (4) Date: Jun. 9, 2003

(87) PCT Pub. No.: WO02/057019

PCT Pub. Date: Jul. 25, 2002

(65) Prior Publication Data

US 2004/0023783 A1 Feb. 5, 2004

(30) Foreign Application Priority Data

Jan. 19, 2001 (DE) ..... 101 02 253

(51) Int. Cl.[7] ..... B04B 1/14
(52) U.S. Cl. ..... 494/70; 267/174
(58) Field of Search ..... 494/1–3, 11, 23–30, 494/38, 40, 41, 47, 48, 56, 67–73; 267/150, 174

(56) References Cited

U.S. PATENT DOCUMENTS

| | | | | |
|---|---|---|---|---|
| 3,189,267 | A | * | 6/1965 | Wilhelm |
| 3,494,546 | A | * | 2/1970 | Nilson |
| 3,550,843 | A | * | 12/1970 | Hoffmann |
| 3,823,868 | A | * | 7/1974 | Baram |
| 4,164,317 | A | | 8/1979 | Nelson |
| 4,238,104 | A | * | 12/1980 | Hamilton |
| 4,354,632 | A | * | 10/1982 | Stroucken |
| 4,401,429 | A | | 8/1983 | Koslowski |
| 4,510,052 | A | * | 4/1985 | Eklof |
| 4,670,005 | A | * | 6/1987 | Kohlstette et al. |
| 6,319,186 | B1 | * | 11/2001 | Pitkamaki |
| 6,648,809 | B1 | * | 11/2003 | Mackel et al. |

FOREIGN PATENT DOCUMENTS

| | | | |
|---|---|---|---|
| DE | 594 461 | | 3/1934 |
| DE | 30 09 669 | A1 | 9/1981 |
| DE | 3607526 | A1 * | 9/1987 |
| DE | 3832979 | A1 * | 4/1990 |
| DE | 199 22 236 | A1 | 11/2000 |
| DE | 10143411 | A1 * | 4/2004 |
| EP | 706829 | A1 * | 4/1996 |
| GB | 312997 | | 3/1930 |
| JP | 57-30559 | * | 2/1982 |

* cited by examiner

*Primary Examiner*—Charles E. Cooley
(74) *Attorney, Agent, or Firm*—Barnes & Thornburg

(57) ABSTRACT

A centrifuge that includes a centrifugal drum having a drum part, a centrifuge chamber bottom, a drum cover, solid matter discharge openings in a jacket area of a drum bottom part, and a piston valve axially movably disposed in the drum bottom part. The piston valve is held in a closed position by springs supported at the drum bottom part. The piston valve is movable by a control medium introduced into an opening chamber between the piston valve and the centrifuge chamber bottom. The control medium can overcome the springs and open the solid matter discharge openings. The springs are made from an unalloyed spring steel and are substantially encapsulated by sleeves made of corrosion resistant material. The sleeves project on one side into the piston valve and, on the other side, into bores of a bottom area of the drum bottom part.

4 Claims, 2 Drawing Sheets

CENTRIFUGE

BACKGROUND AND SUMMARY OF THE INVENTION

The present invention relates to a centrifuge having a centrifugal drum. The drum includes a drum bottom part, a centrifuge chamber bottom, a drum cover and a piston valve. The piston valve is axially movably disposed in the drum bottom part and is held by springs supported at the drum bottom part in a closed position. The piston valve is configured to open and close solid-matter discharge openings provided in the jacket area of the drum bottom part. The piston valve is movable by a control medium, which can be introduced into an opening chamber arranged between the piston valve, on one side, and a centrifuge chamber bottom, on the another side. The control medium acts against the effect of the springs premixing the piston valve to move into a position to open the solid-matter discharge openings.

Centrifuges or separators of the above-mentioned type are basically known. Reference is made here, for example, to U.S. Patent Document U.S. Pat. No. 4,164,317 as well as to German Patent Document DE 30 09 669.

For hygienic reasons, springs made of stainless materials are used in the case of the centrifuges or separators of the above-mentioned type.

By using springs made of a stainless material, a relatively large space is required for the accommodation of the springs. That is because springs made of stainless materials, in comparison to springs made of, for instance, unalloyed spring steel, require considerably larger dimensions to achieve the same forces.

An aspect of the present invention is a centrifuge of the above-mentioned type having only a relatively small space required for housing the springs.

According to the present invention, springs are made of an unalloyed spring steel and are encapsulated by sleeves made of a corrosion-resistant material. On one side, the springs project into a piston valve and, on another side, the springs project into bores of a bottom area of a drum bottom part.

By this comparatively simple and cost-effective construction, on the one hand, a high closing force is achieved and, on the other hand, a large piston valve stroke is achieved while the space for accommodating the springs is minimal. At the same time, a perfect insulation of each spring chamber with respect to a sterile chamber of the centrifuge is ensured.

Also an abrasion by friction under centrifugal force as well as corrosion influences upon the product being centrifuged are avoided.

These and other aspects of the present invention will become apparent from the following detailed description of the invention, when considered in conjunction with accompanying drawings. dr

DETAILED DESCRIPTION OF THE PREFERRED EMBODIMENTS

Figure 1:
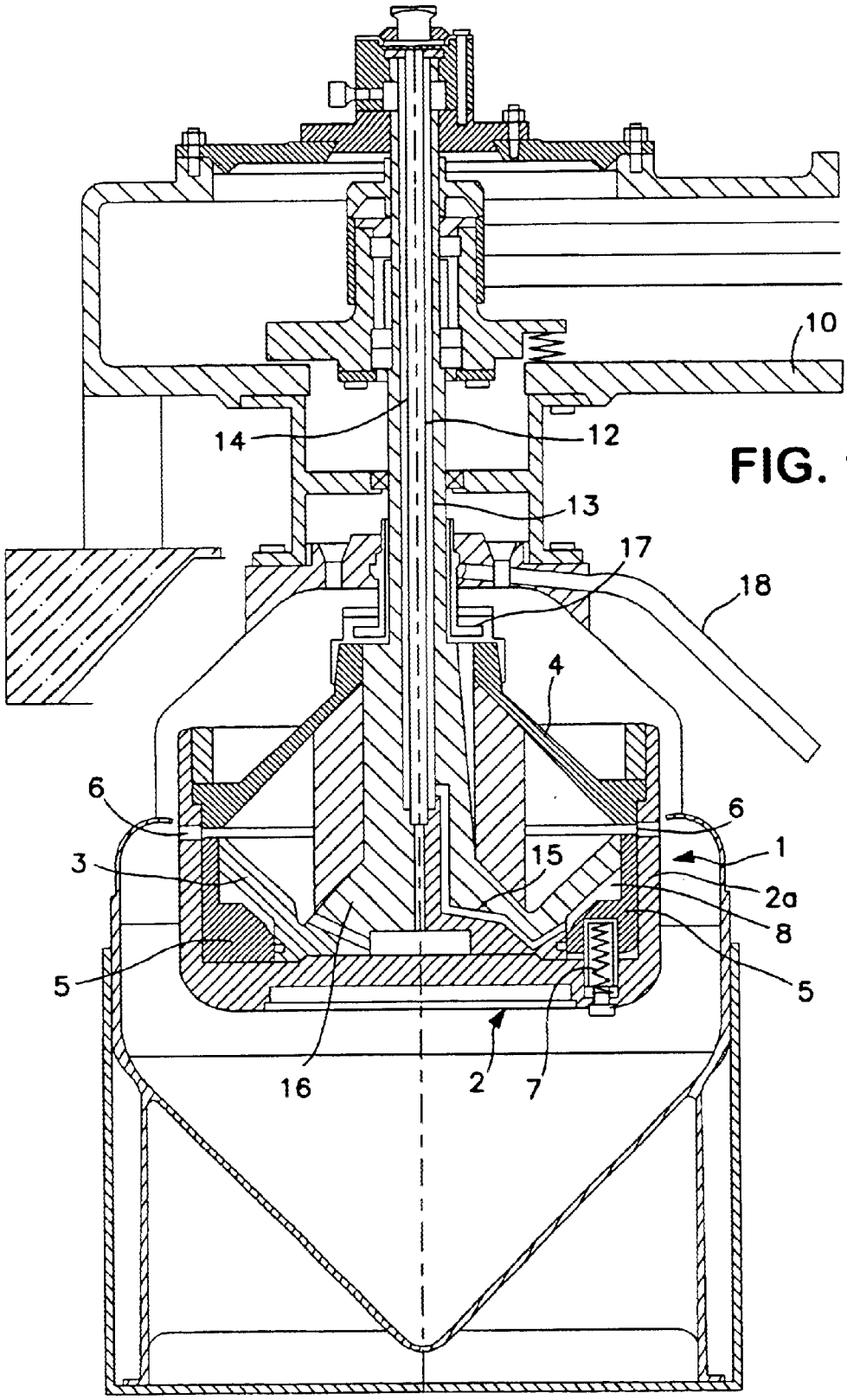
FIG. 1 is a sectional view of a centrifuge according to the principles of the present invention.

FIG. 1 illustrates a centrifuge having a centrifugal drum 1 which comprises a drum bottom part 2, a centrifuge chamber bottom 3, a drum cover 4 as well as a piston valve 5. The piston valve 5 is axially movably disposed in the drum bottom part 2.

The centrifuge is constructed as a separator and is suspended via a machine frame 10. Material to be centrifuged is fed through a feeding tube 12 from above into the centrifugal drum 1. A tube 13 is arranged concentrically to the feeding tube 12, so that a control fluid, such as sterile control air, can be fed through space 14 between the feeding tube 12 and the tube 13.

The space 14 leads into a passage 15 in a distributor 16, and passage 15 leads into opening chamber 8.

The material to be centrifuged is collected in distributor 16 in the suspended centrifugal drum 1.

A liquid phase is discharged via the separating disk 17 and pipe 18.

In the right-hand half of FIG. 1, the piston valve 5 is shown in a closed position. In this closed position solid-matter discharge openings 6, which are provided in jacket area 2*a* of drum bottom part 2 are tightly closed by the piston valve 5. In the left-hand half of FIG. 1, the piston valve 5 is shown in an open position. In this position, the solid-matter discharge openings 6 of the drum bottom part 2 are open.

As illustrated in the right-hand half in FIG. 1, the piston valve 5 is held in its closed position by several springs 7, only one of which is shown.

An opening of the piston valve 5 is achieved by introduction of a control medium, preferably compressed air, into opening chamber 8. Opening chamber 8 is formed between the control piston 5, on one side, and centrifuge chamber bottom 3, on another side. A pressure is built up which overcomes the forces of the springs 7 and thereby moves the piston valve 5 into the opening position illustrated in the left-hand half of FIG. 1. When, inversely, the opening chamber 8 is depressurized, the springs 7 move the piston valve 5 back into the closed position illustrated in the right-hand half of FIG. 1.

The springs 7 are made, for example, of an unalloyed spring steel, and encapsulated in sleeves 20 made of, for example, a corrosion-resistant material. The springs 7, one side project into the piston valve 5 and, on the other side, project into bores 9 of bottom area 2*b* of the drum bottom part 2.

The sleeves 20 are closed on a face 20*a* at ends projecting into the piston valve 5. An end of the springs 7 is supported by a portion of the face 20*a* of the sleeves 20.

In the sides projecting into the bores 9 of the drum bottom part 2, the sleeves 20 are sealed off by at least one sealing ring 11 with respect to the bores 9.

Figure 2:
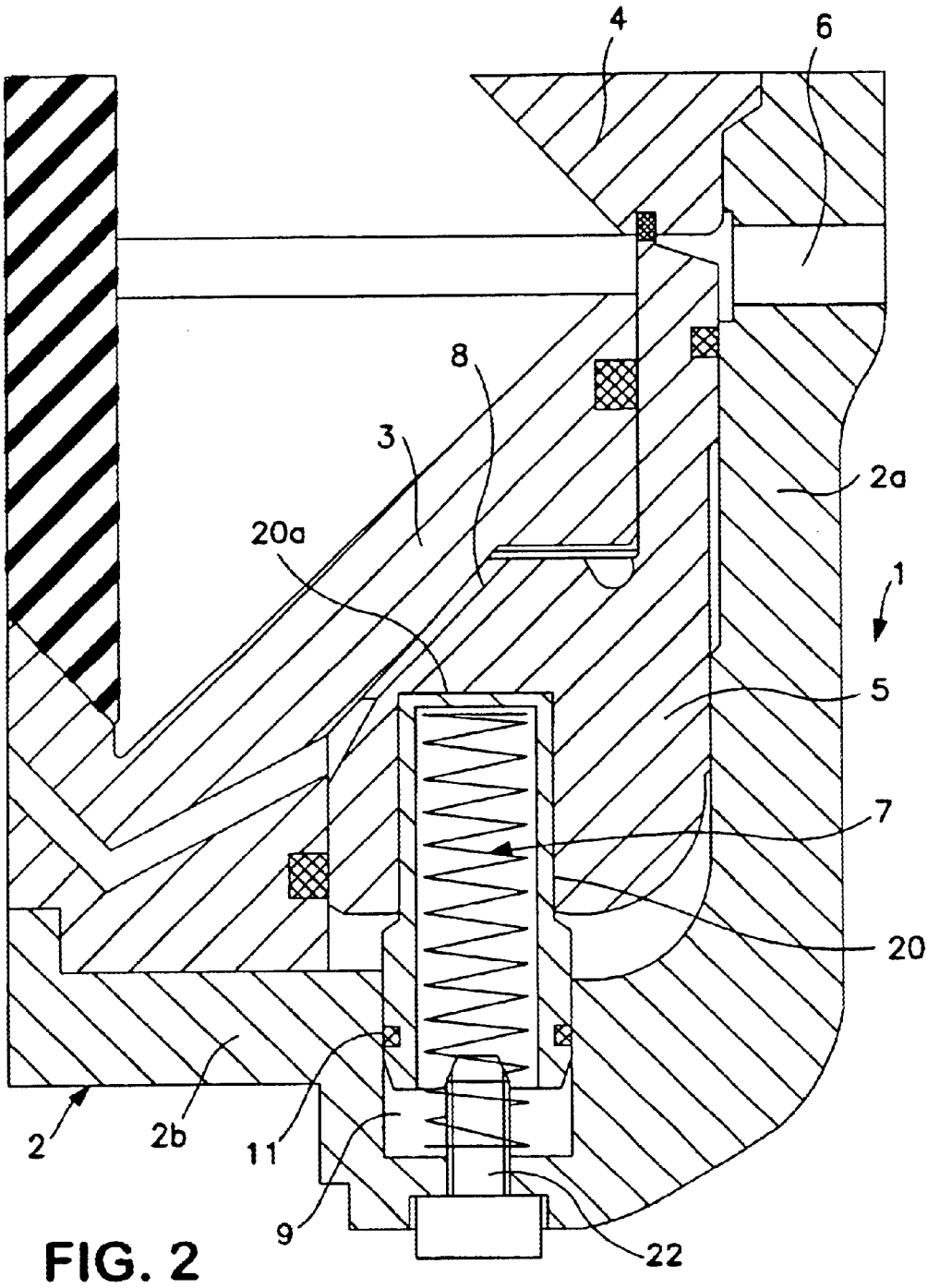
FIG. 2 is an enlarged view of a portion of the centrifuge of FIG. 1.

Furthermore, as shown in FIG. 2, ends of the springs 7 projecting into the bores 9 of the drum bottom part 2 are guided on guide pins 22, while a remaining area of the springs 7 is secured by the sleeves 20 against lateral deflections.

As a result of the springs 7 being made of an unalloyed spring steel, it becomes possible to provide a particularly space-saving construction so that, despite relatively small dimensions of the springs 7, large closing forces are achieved for the piston valve 5. Likewise, a relatively large piston valve stroke can be implemented while the dimensions of the springs 7 are relatively small. By encapsulation of the springs 7, a highly effective insulation of such a spring chamber with respect to a sterile chamber of the centrifuge is ensured, and an abrasion by friction or centrifugal force as well corrosion influences upon a centrifuged product may be reliably avoided.

Although the present invention has been described and illustrated in detail, it is to be clearly understood that this is done by way of illustration and example only and is not to be taken by way of limitation. The scope of the present invention is to be limited only by the terms of the appended claims.

What is claimed is:

1. A centrifuge, comprising:

a centrifugal drum including a drum part, a centrifuge chamber bottom, a drum cover, solid matter discharge openings in a jacket area of a drum bottom part, and a piston valve axially movably disposed in the drum bottom part and held in a closed position by springs supported at the drum bottom part, the piston valve being movable by a control medium introduced into an opening chamber between the piston valve and the centrifuge chamber bottom, which control medium can overcome the springs and open the solid matter discharge openings, and wherein the springs are made from an unalloyed spring steel and substantially encapsulated by sleeves made of corrosion resistant material, the sleeves projecting on one side into the piston valve and, on another side, into bores of a bottom area of the drum bottom part.

2. The centrifuge according to claim 1, wherein the sleeves are closed on a face at ends projecting into the piston valve and ends of the springs are supported by a portion of the face of the sleeves.

3. The centrifuge according to claim 2, wherein the ends of the springs projecting into the bores of the drum bottom part are guided on guide pins.

4. The centrifuge according to claim 1 wherein in the sides of the sleeves projecting into the bores of the drum bottom part, the sleeves are sealed off by at least one sealing ring with respect to the bores.

* * * * *